US005691297A

United States Patent [19]

Nassano et al.

[11] Patent Number: 5,691,297

[45] Date of Patent: *Nov. 25, 1997

[54] PROCESS FOR MAKING A HIGH DENSITY DETERGENT COMPOSITION BY CONTROLLING AGGLOMERATION WITHIN A DISPERSION INDEX

[75] Inventors: David Robert Nassano, Cold Springs, Ky.; Scott William Capeci, North Bend, Ohio

[73] Assignee: The Procter & Gamble Company, Cincinnati, Ohio

[ * ] Notice: The term of this patent shall not extend beyond the expiration date of Pat. No. 5,489,392.

[21] Appl. No.: 530,545

[22] Filed: Sep. 19, 1995

Related U.S. Application Data

[63] Continuation-in-part of Ser. No. 309,215, Sep. 20, 1994, Pat. No. 5,489,392.

[51] Int. Cl.[6] ..... C11D 11/00

[52] U.S. Cl. ..... 510/444; 510/441; 510/457; 510/507; 510/509; 510/511; 264/117; 264/140

[58] Field of Search ..... 252/89.1, 174, 252/135, 174.14, 174.25; 264/117, 140; 510/444, 441, 457, 507, 509, 511

[56] References Cited

U.S. PATENT DOCUMENTS

| | | | |
|---|---|---|---|
| 4,894,117 | 1/1990 | Bianchi et al. | 159/49 |
| 4,919,847 | 4/1990 | Barletta et al. | 252/558 |
| 5,108,646 | 4/1992 | Beerse et al. | 252/174.25 |
| 5,133,924 | 7/1992 | Appel et al. | 264/342 R |
| 5,160,657 | 11/1992 | Bortolotti et al. | 252/174.14 |
| 5,205,958 | 4/1993 | Swatling et al. | 252/174.13 |
| 5,366,652 | 11/1994 | Capeci et al. | 252/89.1 |
| 5,489,392 | 2/1996 | Capeci et al. | 252/89.1 |

FOREIGN PATENT DOCUMENTS

| | | | |
|---|---|---|---|
| 0 351 937 A1 | 1/1990 | European Pat. Off. | C11D 11/00 |
| 0 451 894 A1 | 10/1991 | European Pat. Off. | C11D 10/04 |
| 0 510 746 A2 | 10/1992 | European Pat. Off. | C11D 11/00 |
| 1 517 713 | 7/1978 | United Kingdom | C11D 17/06 |

*Primary Examiner*—Paul Lieberman
*Assistant Examiner*—Lorna M. Douyon
*Attorney, Agent, or Firm*—Jacobus C. Rasser; Jerry J. Yetter; Ken K. Patel

[57] ABSTRACT

A process for continuously preparing high density detergent composition is provided. The process comprises the steps of: (a) agglomerating a detergent surfactant paste and dry starting detergent material in a high speed mixer/densifier to obtain agglomerates having a Dispersion Index in a range of from about 1 to about 6, wherein Dispersion Index=A/B A is the surfactant level in the agglomerates having a particle size of at least 1100 microns, and B is the surfactant level in the agglomerates having a particle size less than about 150 microns; (b) mixing the agglomerates in a moderate speed mixer/densifier to further densify, build-up and agglomerate the agglomerates; and (c) conditioning the agglomerates such that the flow properties of the agglomerates are improved, thereby forming the high density detergent composition.

15 Claims, 1 Drawing Sheet

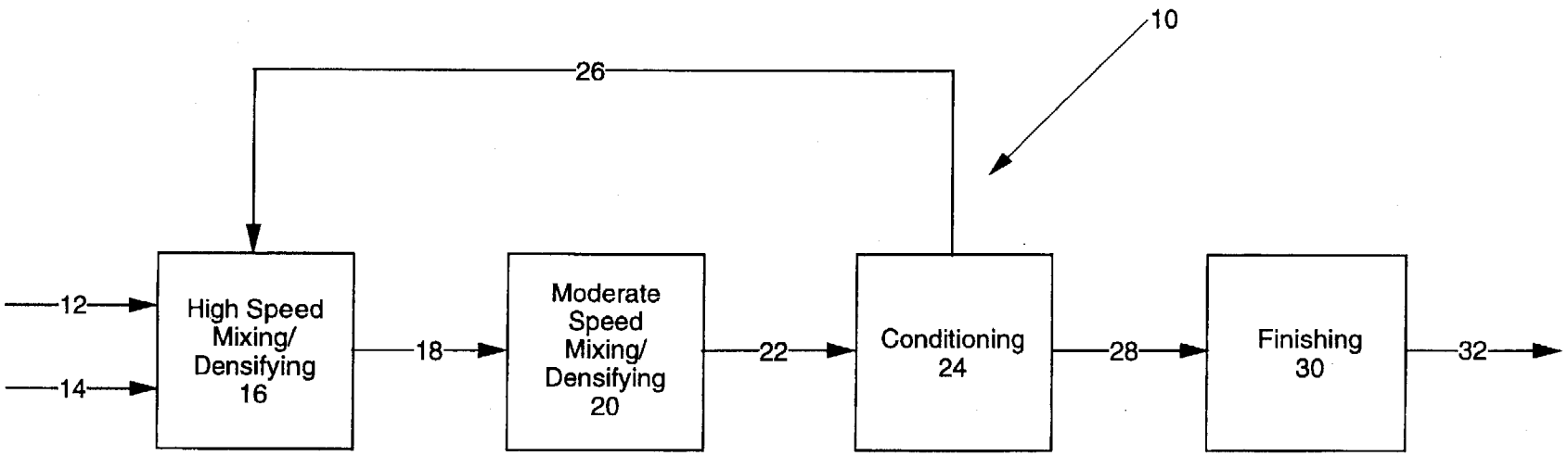
10
12
14
High Speed Mixing/ Densifying 16
18
Moderate Speed Mixing/ Densifying 20
22
Conditioning 24
26
28
Finishing 30
32

PROCESS FOR MAKING A HIGH DENSITY DETERGENT COMPOSITION BY CONTROLLING AGGLOMERATION WITHIN A DISPERSION INDEX

CROSS REFERENCE TO RELATED APPLICATION

This is a Continuation-in-Part application of application Ser. No. 08/309,215, filed Sep. 20, 1994, which issued as U.S. Pat. No. 5,489,392 on Feb. 6, 1996.

FIELD OF THE INVENTION

The present invention generally relates to a process for producing a high density laundry detergent composition. More particularly, the invention is directed to a process during which high density detergent agglomerates are produced by feeding a surfactant paste and dry starting detergent material into two serially positioned mixer/densifiers and then into one or more conditioning apparatus in the form of drying, cooling and screening equipment. The process is operated within a selected binder dispersion index resulting in agglomerates having a more uniform distribution of binder. This also results in the production of lower amounts of oversized and undersized agglomerate particles, thereby minimizing the need for one or more recycle streams in the process. While the binder can be most any liquid used to enhance agglomeration of dry ingredients, the process herein focuses on a surfactant as the binder.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example, with a density of 650 g/l or higher. The low dosage detergents are currently in high demand as they conserve resources and can be sold in small packages which are more convenient for consumers.

Generally, there are two primary types of processes by which detergent particles or powders can be prepared. The first type of process involves spray-drying an aqueous detergent slurry in a spray-drying tower to produce highly porous detergent particles. In the second type of process, the various detergent components are dry mixed after which they are agglomerated with a binder such as a nonionic or anionic surfactant. In both processes, the most important factors which govern the density of the resulting detergent material are the density, porosity, particle size and surface area of the various starting materials and their respective chemical composition. These parameters, however, can only be varied within a limited range. Thus, a substantial bulk density increase can only be achieved by additional processing steps which lead to densification of the detergent material.

There have been many attempts in the art for providing processes which increase the density of detergent particles or powders. Particular attention has been given to densification of spray-dried particles by "post-tower" treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide a continuous processes for increasing the density of "post-tower" or spray dried detergent particles. Typically, such processes require a first apparatus which pulverizes or grinds the particles and a second apparatus which increases the density of the pulverized particles by agglomeration. These processes achieve the desired increase in density only by treating or densifying "post tower" or spray dried particles.

However, all of the aforementioned processes are directed primarily for densifying or otherwise processing spray dried particles. Currently, the relative amounts and types of materials subjected to spray drying processes in the production of detergent particles has been limited. For example, it has been difficult to attain high levels of surfactant in the resulting detergent composition, a feature which facilitates production of low dosage detergents. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which starting detergent materials in the form of pastes, liquids and dry materials can be effectively agglomerated into crisp, free flowing detergent agglomerates having a high density of at least 650 g/l.

Moreover, such agglomeration processes have produced detergent agglomerates containing a wide range of particle sizes, for example "overs" and "fines" are typically produced. The "overs" or larger than desired agglomerate particles have a tendency to decrease the overall solubility of the detergent composition in the washing solution which leads to poor cleaning and the presence of insoluble "clumps" ultimately resulting in consumer dissatisfaction. The "fines" or smaller than desired agglomerate particles have a tendency to "gel" in the washing solution and also give the detergent product an undesirable sense of "dustiness." Further, past attempts to recycle such "overs" and "fines" has resulted in the exponential growth of additional undesirable over-sized and undersized agglomerates since the "overs" typically provide a nucleation site or seed for the agglomeration of even larger particles, while recycling "fines" inhibits agglomeration leading to the production of more "fines" in the process. Also, the recycle streams in such processes increase the operating costs of the process which inevitably increase the detergent product cost ultimately produced.

Accordingly, there remains a need in the art for a process which produces a high density detergent composition having improved flow and particle size properties. Further, there is a need for such a process which decreases or minimizes the need for recycle streams in the process. Also, there remains a need for such a process which is more efficient and economical to facilitate large-scale production of low dosage or compact detergents.

BACKGROUND ART

The following references are directed to densifying spray-dried granules: Appel et al, U.S. Pat. No. 5,133,924 (Lever);

Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Capeci et al, U.S. Pat. No. 5,366,652 (Procter & Gamble); Hollingsworth et al, European Patent Application 351,937 (Unilever); and Swatling et al, U.S. Pat. No. 5,205,958.

SUMMARY OF THE INVENTION

The present invention meets the aforementioned needs in the art by providing a process which produces a high density detergent composition containing agglomerates directly from starting detergent ingredients. The process invention described herein produces agglomerates within a selected Dispersion Index indicative of the uniformity of the surfactant level throughout the agglomerate particles. It has been surprisingly found that by maintaining the agglomerates within this Dispersion Index, the process produces less particles which are oversized or "overs" (i.e. over 1100 microns) and undersized or "fines" (i.e. less than 150 microns). This obviates the need for extensive recycling of undersized and oversized agglomerate particles resulting in a more economical process and a high density detergent composition having improved flow properties and a more uniform particle size. Such features ultimately result in a low dosage or compact detergent product having more acceptance by consumers.

As used herein, the term "agglomerates" refers to particles formed by agglomerating starting detergent ingredients (liquid and/or particles) which typically have a smaller median particle size than the formed agglomerates. All percentages and ratios used herein are expressed as percentages by weight (anhydrous basis) unless otherwise indicated. All documents are incorporated herein by reference. All viscosities referenced herein are measured at 70° C. (±5° C.) and at shear rates of about 10 to 100 $sec^{-1}$.

In accordance with one aspect of the invention, a process for continuously preparing high density detergent composition is provided. The process comprises the steps of: (a) agglomerating a detergent surfactant paste and dry starting detergent material in a high speed mixer/densifier to obtain agglomerates having a Dispersion Index in a range of from about 1 to about 6, wherein $$\text{Dispersion Index}=A/B$$

A is the surfactant level in the agglomerates having a particle size of at least 1100 microns, and B is the surfactant level in the agglomerates having a particle size less than about 150 microns; (b) mixing the agglomerates in a moderate speed mixer/densifier to further densify, build-up and agglomerate the agglomerates; and (c) conditioning the agglomerates such that the flow properties of the agglomerates are improved, thereby forming the high density detergent composition.

In accordance with another aspect of the invention, another process for preparing high density detergent composition is provided. This process comprises the steps of: (a) agglomerating a detergent surfactant paste and dry starting detergent material in a high speed mixer/densifier to obtain agglomerates having a Dispersion Index in a range of from about 1 to about 6, wherein $$\text{Dispersion Index}=A/B$$

A is the surfactant level in the agglomerates having a particle size of at least 1100 microns, and B is the surfactant level in the agglomerates having a particle size less than about 150 microns; (b) mixing the agglomerates in a moderate speed mixer/densifier to further densify, build-up and agglomerate the agglomerates; (c) feeding the agglomerates into a conditioning apparatus for improving the flow properties of the agglomerates and for separating the agglomerates into a first agglomerate mixture and a second agglomerate mixture, wherein the first agglomerate mixture substantially has a particle size of less than about 150 microns and the second agglomerate mixture substantially has a particle size of at least about 150 microns; (d) recycling the first agglomerate mixture into the high speed mixer/densifier for further agglomeration; and (e) admixing adjunct detergent ingredients to the second agglomerate mixture so as to form the high density detergent composition.

Another aspect of the invention is directed to a high density detergent composition made according to any one of the embodiments of the instant process.

Accordingly, it is an object of the invention to provide a process which produces a high density detergent composition containing agglomerates having improved flow and particle size properties. It is also an object of the invention to provide such a process which is more efficient and economical to facilitate large-scale production of low dosage or compact detergents. These and other objects, features and attendant advantages of the present invention will become apparent to those skilled in the art from a reading of the following detailed description of the preferred embodiment and the appended claims.

BRIEF DESCRIPTION OF THE DRAWING

FIG. 1 is a flow diagram of a process in accordance with one embodiment of the invention in which undersized detergent agglomerates are recycled back into the high speed mixer/densifier from the conditioning apparatus.

DETAILED DESCRIPTION OF THE PREFERRED EMBODIMENT

Reference can be made to FIG. 1 for purposes of illustrating one preferred embodiment of the process invention described herein.

Process

Initially, the process 10 shown in FIG. 1 entails agglomerating a detergent surfactant paste 12 and dry starting detergent material 14 in a high speed mixer/densifier 16 to obtain agglomerates 18. It is preferable for the ratio of the surfactant paste to the dry detergent material to be from about 1:10 to about 10:1 and more preferably from about 1:4 to about 4:1. The various ingredients which may be selected for the surfactant paste 12 and the dry starting detergent material 14 are described more fully hereinafter.

It has been surprisingly found that by agglomerating the surfactant paste 12 and the dry starting detergent material 14 in the high speed mixer/densifier 16 such that the agglomerates have a Dispersion Index is in a range from about 1 to about 6, more preferably from about 1 to about 4, and most preferably from about 1 to about 2, the actual amount of undersized and oversized agglomerate particles produced is significantly reduced. In this way, the need for recycling the undersized agglomerate particles and/or the oversized agglomerate particles is reduced or minimized. This substantially reduces the cost of operating the process.

The Dispersion Index as defined herein equals A/B, wherein A is the surfactant level in the agglomerates having a particle size at least about 1100 microns, and B is the surfactant level in the agglomerates having a particle size of less than about 150 microns. The agglomerate particles having a size over 1100 microns generally represent the "overs" or oversized particles, while the particles having a size of less than 150 microns generally represent the "fines" or undersized particles.

While not intending to be bound by theory, it is believed that maintaining the index (Dispersion Index) of surfactant level in the oversized particles over (or divided by) the surfactant level in the undersized particles as close to 1 as possible results in a more uniform distribution of the surfactant. This inevitably leads to the production of lesser amounts of oversized and undersized agglomerate particles in that there are less particles which are excessively "sticky" (i.e. high amounts of surfactant) and tend to over agglomerate into oversized particles, and less particles which are not "sticky" enough (i.e. low amounts of surfactant) and tend not to be built up sufficiently causing undersized particles to be produced. Additionally, failure to maintain the Dispersion Index within the selected range described herein results in the formation of paste droplets and powder clumps which are not agglomerated sufficiently. Thus, by operating the instant process within the specified Dispersion Index, the need for recycling agglomerates is minimized and the flow properties of the agglomerates is surprisingly enhanced.

Preferably, the agglomerates can be maintained at the selected Dispersion Index by controlling one or more operating parameters of the high speed mixer/densifier 16 and/or the temperature and flow rate of the surfactant paste 12 and the dry starting detergent material 14. Such operating parameters include, residence time, speed of the mixer/densifier, and the angle and/or configuration of the mixing tools and shovels in the mixer/densfier. It will be appreciated by those skilled in the art that one or more of these conventional operating parameters may be varied to obtain agglomerates within the selected Dispersion Index.

One convenient adjustment means is to control the speed of the high speed mixer/densifier by setting the speed in a range of from about 100 rpm to about 2500 rpm, more preferably from about 300 rpm to about 1800 rpm, and most preferably from about 500 rpm to about 1600 rpm. Of course, those skilled in the art will understand that the aforementioned operating parameters are just a few of many which can be varied to obtain the desired Dispersion Index as described herein and the specific parameters will be dependent upon the other processing parameters. Such varying of the instant process parameters is well within the scope of the ordinary skilled artisan.

The agglomerates 18 are then sent or fed to a moderate speed mixer/densifier 20 to densify and build-up further and agglomerate the agglomerates 18. It should be understood that the dry starting detergent material 14 and surfactant paste 12 are built-up into agglomerates in the high speed mixer/densifier 16, thus resulting in the agglomerates 18 which, in accordance with this invention, have a Dispersion Index as defined herein. The agglomerates 18 are then built-up further in the moderate speed mixer/densifier 20 resulting in further densified or built-up agglomerates 22 which are ready for further processing to increase their flow properties. By operating the high speed mixer/densifier 16 within the selected Dispersion Index, the ultimate Dispersion Index of the agglomerates in the moderate speed mixer/densifier 20 is also unexpectedly maintained at the desired level. In fact, the Dispersion Index of the agglomerates in the moderate speed mixer/densifier 20 is preferably from about 1 to about 4, more preferably from about 1 to about 3, and most preferably from about 1 to about 1.5.

Typical apparatus used in process 10 for the high speed mixer/densifier 16 include but are not limited to a Lödige Recycler CB-30 while the moderate speed mixer/densifier 20 can be a Lödige Recycler KM-600 "Ploughshare". Other apparatus that may be used include conventional twin-screw mixers, mixers commercially sold as Eirich, Schugi, O'Brien, and Drais mixers, and combinations of these and other mixers. Residence times of the agglomerates/ingredients in such mixer/densifiers will vary depending on the particular mixer/densifier and operating parameters. However, the preferred residence time in the high speed mixer/densifier 16 is from about 2 seconds to about 45 seconds, preferably from about 5 to 30 seconds, and most preferably from about 10 seconds to about 15 seconds, while the residence time in the moderate speed mixer/densifier is from about 0.5 minutes to about 15 minutes, preferably from about 1 to 10 minutes.

Optionally, a coating agent can be added just before, in or after the high speed mixer/densifier 16 to control or inhibit the degree of agglomeration. This optional step provides a means by which the desired agglomerate particle size can be achieved. Preferably, the coating agent is selected from the group consisting of aluminosilicates, sodium carbonate, crystalline layered silicates, $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and mixtures thereof. Another optional step entails spraying a binder material into the high speed mixer/densifier 16 so as to facilitate build-up agglomeration. Preferably, the binder is selected from the group consisting of water, anionic surfactants, nonionic surfactants, polyethylene glycol, polyvinyl pyrrolidone, polyacrylates, citric acid and mixtures thereof.

Another step in the process 10 entails feeding the further densified agglomerates 22 into a conditioning apparatus 24 which preferably includes one or more of a drying apparatus and a cooling apparatus (not shown individually). The conditioning apparatus 24 in whatever form (fluid bed dryer, fluid bed cooler, airlift, etc.) is included for improving the flow properties of the agglomerates 22 and for separating them into a first agglomerate mixture 26 and a second agglomerate mixture 28. Preferably, the agglomerate mixture 26 substantially has a particle size of less than about 150 microns (i.e. undersized particles) and the agglomerate mixture 28 substantially has a particle size of at least about 150 microns. Of course, it should be understood by those skilled in the art that such separation processes are not always perfect and there may be a small portion of agglomerate particles in agglomerate mixture 26 or 28 which is outside the recited size range. The ultimate goal of the process 10, however, is to divide a substantial portion of the "fines" or undersized agglomerates 26 from the more desired sized agglomerates 28 which are then sent to one or more finishing steps 30.

The agglomerate mixture 26 is recycled back into the high speed mixer/densifier 16 for further agglomeration such that the agglomerates in mixture 26 are ultimately built-up to the desired agglomerate particle size. However, it has been found by operating within the Dispersion Index as mentioned previously, the amount of the agglomerate mixture 26 is unexpectedly reduced, thereby increasing the efficiency of the instant process. Preferably, the finishing steps 30 will include admixing adjunct detergent ingredients to agglomerate mixture 28 so as to form a fully formulated high density detergent composition 32 which is ready for commercialization. In a preferred embodiment, the detergent composition 32 has a density of at least 650 g/l. Optionally, the finishing steps 30 includes admixing conventional spray-dried detergent particles to the agglomerate mixture 28 along with adjunct detergent ingredients to form detergent composition 32. In this case, detergent composition 32 preferably comprises from about 10% to about 40% by weight of the agglomerate mixture 28 and the balance spray-dried detergent particles and adjunct ingredients.

Detergent Surfactant Paste

The detergent surfactant paste used in the processes 10 is preferably in the form of an aqueous viscous paste, although forms are also contemplated by the invention. This so-called viscous surfactant paste has a viscosity of from about 5,000 cps to about 100,000 cps, more preferably from about 10,000 cps to about 80,000 cps, and contains at least about 10% water, more preferably at least about 20% water. The viscosity is measured at 70° C. and at shear rates of about 10 to 100 $sec.^{-1}$. Optionally, the surfactant paste can have a viscosity sufficiently high so as to resemble an extrudate or "noodle" surfactant form or particle. Furthermore, the surfactant paste, if used, preferably comprises a detersive surfactant in the amounts specified previously and the balance water and other conventional detergent ingredients.

The surfactant itself, in the viscous surfactant paste, is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)\ CH_3$ and $CH_3(CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful in the paste of the invention include $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 92/06154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Dry Detergent Material

The starting dry detergent material of the processes 10 preferably comprises a detergency builder selected from the group consisting of aluminosilicates, crystalline layered silicates and mixtures thereof, and carbonate, preferably sodium carbonate. The aluminosilicates or aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z\cdot(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}\cdot(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/ minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Another very viable builder material which can also be used as the coating agent in the process as described previously include materials having the formula $(M_x)_iCa_y(CO_3)_z$ wherein x and i are integers from 1 to 15, y is an integer from 1 to 10, z is an integer from 2 to 25, $M_i$ are cations, at least one of which is a water-soluble, and the equation $\Sigma_{i=1-15}(x_i$ multiplied by the valence of $M_i)+2y=2z$ is satisfied such that the formula has a neutral or "balanced" charge. Waters of hydration or anions other than carbonate may be added provided that the overall charge is balanced or neutral. The charge or valence effects of such anions should be added to the right side of the above equation.

Preferably, there is present a water-soluble cation selected from the group consisting of hydrogen, water-soluble metals, hydrogen, boron; ammonium, silicon, and mixtures thereof, more preferably, sodium, potassium, hydrogen, lithium, ammonium and mixtures thereof, sodium and potassium being highly preferred. Nonlimiting examples of non-carbonate anions include those selected from the group consisting of chloride, sulfate, fluoride, oxygen, hydroxide, silicon dioxide, chromate, nitrate, borate and mixtures thereof. Preferred builders of this type in their simplest forms are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof. An especially preferred material for the builder described herein is $Na_2Ca(CO_3)_2$ in any of its crystalline modifications.

Suitable builders of the above-defined type are further illustrated by, and include, the natural or synthetic forms of any one or combinations of the following minerals: Afghanite, Andersonite, AshcroftineY, Beyerite, Borcarite, Burbankite, Butschliite, Cancrinite, Carbocernaite, Carletonite, Davyne, DonnayiteY, Fairchildite, Ferrisurite, Franzinite, Gaudefroyite, Gaylussite, Girvasite, Gregoryite, Jouravskite, KamphaugiteY, Kettnerite, Khanneshite, LepersonniteGd, Liottite, MckelveyiteY, Microsommite, Mroseite, Natrofairchildite, Nyerereite, RemonditeCe, Sacrofanite, Schrockingerite, Shortite, Surite, Tunisite, Tuscanite, Tyrolite, Vishnevite, and Zemkorite. Preferred mineral forms include Nyererite, Fairchildite and Shortite.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the aforementioned Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE

This Example illustrates the process of the invention which produces free flowing, crisp, high density detergent composition. Two feed streams of various detergent starting ingredients are continuously fed, at the several rates noted in Table II below, into a Lödige CB-30 mixer/densifier, one of which comprises a surfactant paste containing surfactant and water and the other stream containing starting dry detergent material containing aluminosilicate and sodium carbonate. The rotational speeds of the shaft in the Lödige CB-30 mixer/densifier are also given in Table II and the mean residence time is about 10 seconds. The agglomerates from the Lödige CB-30 mixer/densifier are continuously fed into a Lödige KM-600 mixer/densifier for further agglomeration during which the mean residence time is about 3 to 6 minutes. The resulting detergent agglomerates are then fed to conditioning apparatus including a fluid bed dryer and then to a fluid bed cooler, the mean residence time being about 10 minutes and 15 minutes, respectively. The undersized or "fine" agglomerate particles (less than about 150 microns) from the fluid bed dryer and cooler are recycled back into the Lödige CB-30 mixer/densifer. The composition of the detergent agglomerates exiting the Lödige KM-600 mixer/densifier is set forth in Table I below:

TABLE I

| Component | % Weight |
|---|---|
| $C_{14-15}$ alkyl sulfate | 21.6 |
| $C_{12.3}$ linear alkylbenzene sulfonate | 7.2 |
| Aluminosilicate | 32.4 |
| Sodium carbonate | 20.6 |
| Polyethylene glycol (MW 4000) | 0.5 |
| Misc. (water, unreactants, etc.) | 10.1 |
| | 100.0 |

A coating agent, aluminosilicate, is fed immediately after the Lödige KM-600 mixer/densifier but before the fluid bed dryer to enhance the flowability of the agglomerates. The detergent agglomerates exiting the fluid bed cooler are screened, after which adjunct detergent ingredients are admixed therewith to result in a fully formulated detergent product having a uniform particle size distribution. The density of the agglomerates in Table I is 750 g/l and the median particle size is 700 microns.

Adjunct liquid detergent ingredients including perfumes, brighteners and enzymes are sprayed onto or admixed to the agglomerates/particles described above in the finishing step to result in a fully formulated finished detergent composition.

One or more samples of the agglomerates formed in Lödige CB-30 mixer/densifer are taken and subjected to standard sieving techniques that utilize a stack of screens and a rotap machine to separate particles having a size at least 1100 microns (oversized) and particles having a size of less than 150 microns (undersized). The level of surfactant is measured in an oversized particle and in an undersized particle by conventional titration methods. In this Example, the anionic surfactant level in the agglomerate particles are determined by conducting the well known "cat$SO_3$" titration technique. In particular, the agglomerate particle sample is dissolved in an aqueous solution and filtered through 0.45 nylon filter paper to remove the insolubles and thereafter, titrating the filtered solution to which anionic dyes (dimidium bromide) have been added with a cationic titrant such as Hyamine™ commercially available from Sigma Chemical Company. Accordingly, the relative amount of anionic surfactant dissolved in the solution and thus in the particular particle is determined. This technique is well known and others may be used if desired. The Dispersion Index is determined by dividing the surfactant level in an oversized agglomerate particle (referenced previously as "A") by the surfactant level in an undersized agglomerate particle (referenced previously as "B"). Several undersized and oversized particles can be measured for their surfactant level so as to generate several Dispersion Index values for generating statistically significant values. Table II below sets forth exemplary Lödige CB-30 mixer/densifier speeds and starting ingredient flow rates which produce agglomerates with a Dispersion Index within the selected range of 1 to 6.

| Operating Parameters* | Dispersion Index |
|---|---|
| 1542 kg/hr; 800 rpm; and recycle | 5.0 |
| 1329 kg/hr; 800 rpm; and no recycle | 4.6 |
| 1542 kg/hr; 1200 rpm; and recycle | 2.9 |
| 1329 kg/hr; 1200 rpm; and no recycle | 2.7 |
| 1542 kg/hr; 1600 rpm; and recycle | 3.1 |
| 1329 kg/hr; 1600 rpm; and no recycle | 3.1 |
| 771 kg/hr; 800 rpm; and recycle | 2.9 |

-continued

| Operating Parameters* | Dispersion Index |
|---|---|
| 665 kg/hr; 800 rpm; and no recycle | 2.7 |
| 771 kg/hr; 1200 rpm; and recycle | 1.8 |
| 665 kg/hr; 1200 rpm; and no recycle | 1.9 |
| 771 kg/hr; 1600 rpm; and recycle | 2.2 |
| 665 kg/hr; 1600 rpm; and no recycle | 2.0 |

*This includes the total flow rate of the input streams to Lödige CB-30 mixer/densifer including the surfactant paste and dry starting detergent ingredients, the speed of the Lödige CB-30 mixer/densifer, and whether or not a stream of undersized particles (213 kg/hr) from the fluid bed cooler was recycled back into the Lödige CB-30 mixer/densifer during processing.

The agglomerates produced by the process described above within the recited Dispersion Index are unexpectedly crisp, free flowing, and highly dense.

Having thus described the invention in detail, it will be clear to those skilled in the art that various changes may be made without departing from the scope of the invention and the invention is not to be considered limited to what is described in the specification.

What is claimed is:

1. A process for preparing high density detergent composition comprising the steps of:

(a) agglomerating a detergent surfactant paste and dry starting detergent material in a high speed mixer/densifier to obtain agglomerates, wherein said dry starting detergent material comprises a builder selected from the group consisting of aluminosilicates, crystalline layered silicates, sodium carbonate, $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and mixtures thereof;

(b) controlling the flow rate and temperature of said surfactant paste and said dry starting material and the residence time, speed, and mixing tool and shovel configuration of said high speed mixer/densifier such that said agglomerates have a Dispersion Index in a range of from about 1 to about 6, wherein Dispersion Index=A/P A is the surfactant level in said agglomerates having a particle size of at least 1100 microns, and B is the surfactant level in said agglomerates having a particle size less than about 150 microns;

(c) mixing said agglomerates in a moderate speed mixer/densifier to further densify, build-up and agglomerate said agglomerates; and (d) conditioning said agglomerates such that the flow properties of said agglomerates are improved, thereby forming said high density detergent composition having a density of at least about 650 g/l.

2. A process according to claim 1 wherein said conditioning step includes the steps of drying and cooling said agglomerates.

3. A process according to claim 1 wherein the Dispersion Index is from about 1 to about 4.

4. A process according to claim 1 wherein the speed of said high speed mixer/densifier is from about 100 rpm to about 2500 rpm.

5. A process according to claim 1 further comprising the step of adding a coating agent after said high speed mixer/densifier, wherein said coating agent is selected from the group consisting of aluminosilicates, sodium carbonate, crystalline layered silicates, $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and mixtures thereof.

6. A process according to claim 1 wherein the mean residence time of said agglomerates in said high speed mixer/densifier is in a range of from about 2 seconds to about 45 seconds.

7. A process according to claim 1 wherein the mean residence time of said agglomerates in said moderate speed mixer/densifier is in a range of from about 0.5 minutes to about 15 minutes.

8. A process according to claim 1 wherein the mean residence time of said agglomerates in said high speed mixer/densifier is in a range of from about 10 seconds to about 15 seconds.

9. A process according to claim 1 wherein said ratio of said surfactant paste to said dry detergent material is from about 1:10 to about 10:1.

10. A process according to claim 1 wherein said surfactant paste has a viscosity of from about 5,000 cps to about 100,000 cps.

11. A process according to claim 1 wherein said surfactant paste comprises water and a surfactant selected from the group consisting of anionic, nonionic, zwitterionic, ampholytic and cationic surfactants and mixtures thereof.

12. A process for preparing high density detergent composition comprising the steps of:

(a) agglomerating a detergent surfactant paste and dry starting detergent material in a high speed mixer/densifier to obtain agglomerates, wherein said dry detergent material comprises a builder selected from the group consisting of aluminosilicates, crystalline layered silicates, sodium carbonate, $Na_2C_3(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and mixtures thereof;

(b) controlling the flow rate and temperature of said surfactant paste and said dry starting material and the residence time, speed, and mixing tool and shovel configuration of said high speed mixer/densifier such that said agglomerates have a Dispersion Index in a range of from about 1 to about 6, wherein Dispersion Index=A/B A is the surfactant level in said agglomerates having a particle size of at least 1100 microns, and B is the surfactant level in said agglomerates having a particle size less than about 150 microns;

(c) mixing said agglomerates in a moderate speed mixer/densifier to further densify, build-up and agglomerate said agglomerates;

(d) feeding said agglomerates into a conditioning apparatus for improving the flow properties of said agglomerates and for separating said agglomerates into a first agglomerate mixture and a second agglomerate mixture, wherein said first agglomerate mixture substantially has a particle size of less than about 150 microns and said second agglomerate mixture substantially has a particle size of at least about 150 microns; and (e) recycling said first agglomerate mixture into said high speed mixer/densifier for further agglomeration so as to form said high density detergent composition having a density of at least 650 g/l.

13. A process according to claim 12 wherein said conditioning apparatus comprises a fluid bed dryer and a fluid bed cooler.

14. A process according to claim 12 wherein the speed of said high speed mixer/densifier is from about 100 rpm to about 2500 rpm.

15. A process according to claim 12 wherein the mean residence time of said agglomerates in said high speed mixer/densifier is in a range of from about 2 seconds to about 45 seconds.

* * * * *